United States Patent [19]

Kasai

[11] Patent Number: 4,838,331

[45] Date of Patent: Jun. 13, 1989

[54] SLAT OPENING/CLOSING DRIVE MECHANISM IN SHUTTER EQUIPMENT

[75] Inventor: Masanori Kasai, Akishima, Japan

[73] Assignees: Bunka Shutter Co., Ltd.; Lumitter Industry Co., Ltd., both of Tokyo, Japan

[21] Appl. No.: 102,633

[22] Filed: Sep. 30, 1987

[30] Foreign Application Priority Data

| | | | |
|---|---|---|---|
| Oct. 6, 1986 | [JP] | Japan | 61-152458[U] |
| Oct. 6, 1986 | [JP] | Japan | 61-152459[U] |
| Oct. 6, 1986 | [JP] | Japan | 61-152460[U] |
| Oct. 6, 1986 | [JP] | Japan | 61-152461[U] |
| Oct. 6, 1986 | [JP] | Japan | 61-152462[U] |
| Oct. 6, 1986 | [JP] | Japan | 61-152463[U] |

[51] Int. Cl.[4] ..... E04F 10/08

[52] U.S. Cl. ..... 160/36

[58] Field of Search ..... 160/32, 33, 35, 36, 160/37, 220, 310, 214, 224, 133

[56] References Cited

U.S. PATENT DOCUMENTS

| | | | |
|---|---|---|---|
| 2,897,886 | 8/1959 | Pistelli | 160/33 |
| 3,460,602 | 8/1969 | Hugus | 160/265 |
| 4,379,478 | 4/1983 | Lichy | 160/35 |
| 4,494,707 | 1/1985 | Niibori et al. | 160/265 X |
| 4,595,043 | 6/1986 | Nozawa et al. | 160/36 |
| 4,610,289 | 9/1986 | Sugihara | 160/35 |
| 4,662,420 | 5/1987 | Hirao | 160/133 X |

FOREIGN PATENT DOCUMENTS

| | | | |
|---|---|---|---|
| 2703512 | 8/1978 | Fed. Rep. of Germany | 160/35 |
| 2744915 | 4/1979 | Fed. Rep. of Germany | 160/35 |
| 2752432 | 6/1979 | Fed. Rep. of Germany | 160/35 |
| 610054 | 3/1979 | Switzerland | 160/35 |

*Primary Examiner*—Robert W. Gibson, Jr.
*Assistant Examiner*—David M. Purol
*Attorney, Agent, or Firm*—Sherman and Shalloway

[57] ABSTRACT

In a shutter equipment having a shutter for opening and closing an opening portion such as a building entrance, window or the like the shutter being composed of plural slats positioned in a vertically adjacent relation when the shutter is closed, the slats being wound up and pulled down continuously to stow the slats and close the opening portion, respectively; a slat opening/closing mechanism substantially composed of vertical guide rails disposed vertically on both sides of the opening portion; a box positioned on top of the vertical guide rails to stow the slats transversely in parallel in a vertically suspended state; a pair of right and left endless chains which are movable from the vertical guide rails into the slat stowing box and to which are secured through shafts both end faces of the upper portion of each slat; a vertical slat drive mechanism for winding up and pulling down the chains to raise and lower the slats in a suspended state from the vertical guide rails toward the upper portion of the box and reversely from the latter toward the former; sprockets engaged with the chains for controlling the extended state and bent state of the chains smoothly in both the opening portion opening/closing state in which the slats go up and down along the vertical guide rails and the stowed state with the slats stowed in parallel in the box; and a chain-sprocket disengaging mechanism for disengaging the sprockets and the chains from each other.

9 Claims, 11 Drawing Sheets

SLAT OPENING/CLOSING DRIVE MECHANISM IN SHUTTER EQUIPMENT

BACKGROUND OF THE INVENTION

1. Field of the Invention

The present invention relates to a shutter equipment for opening and closing such openings as building entrances and windows and particularly to an improvement of a slat opening/closing drive mechanism in a shutter equipment for opening and closing a plurality of slats which constitute a shutter.

2. Description of the Prior Art

The conventional shutter equipment of this type is composed of vertical guide rails disposed on both sides of an opening for opening and closing a shutter, with a slat stowing box being provided on top of the vertical guide rails; support rails for hanging slats which support rails are disposed within the slat stowing box; a plurality of slats each provided on both sides of the upper end thereof with slat hanging rollers which are movable along the support rails and the vertical guide rails, the slats being connected to a pair of right and left chains each through the slat hanging rollers; and drive means for vertically moving each slat between the vertical guide rails through sprockets engaged with the chains and also moving each slat into the slat stowing box.

The vertical slat drive means is mounted rotatably within the slat stowing box and it has a long rotative shaft engaged with the paired chains and rotated by means of, for example, a geared motor.

Upon operation of the vertical slat drive means in one direction, its rotational force is transmitted to the rotative shift of the drive means and the sprockets are driven rotatively, whereby the slats in the slat stowing box are pulled out successively to the opening between the vertical guide rails through the chains and go down. In this way the slats are arranged in the form of a single vertical plane to close the opening between the vertical guide rails. On the other hand, upon operation of the vertical slat drive means in the opposite direction, the slats arranged between the vertical guide rails go up successively into the slat stowing box, in which the slat hanging rollers mounted on both sides of the upper end of each slat come into engagement with the upper surfaces of the support rails, whereby the slats are suspended in a parallel, folded condition.

More specifically, the vertical slat drive means has a first rotative shaft which is driven by means of, for example, a geared motor and a second rotative shaft for moving the slats up and down interlockedly with the first rotative shaft. On the first rotative shaft are mounted a second sprocket interlocked through an endless chain with a first sprocket which is integral with an output shaft of the geared motor, a pair of right and left, output-side, third and fourth sprockets for driving both the right and left chains, and a fifth sprocket on the output side for transferring the rotational force to the second rotative shaft, while on the second rotative shaft are mounted a sixth sprocket for inputting the rotational force from the first rotative shaft through the fifth sprocket and an endless chain, and a pair of right and left, seventh and eighth sprockets for winding and engaging the chains with respect to the third and fourth sprockets.

When the first rotative shaft is rotated in one direction by the vertical slat drive means, its rotational force is transmitted to the second rotative shaft, whereby the slats stowed in the top box are pulled out to the opening between the vertical guide rails through the chains and go down. In this way the slats are arranged in the form of a single vertical plane to close the opening between the vertical guide rails. On the other hand, when the second rotative shaft is rotated in the opposite direction through the first rotative shaft by the vertical slat drive means, the slats arranged between the vertical guide rails go up successively into the top box, in which the slat hanging rollers positioned on both sides of the upper end of each slat comes into engagement with the upper surfaces of the support rails, whereby the slats are suspended in a parallel, folded condition.

The support rails are each formed by bending a metallic plate in the channel shape in section, and the shaft portion of the slat hanging roller is brought into rolling engagement with the upper end of the vertical wall portion on one side of the channel.

Consequently, the concentric roller portion of a larger diameter connected integrally with the above roller shaft portion floats from the support rail and it functions as a rotation stopping flange portion to prevent the roller shaft portion from being disengaged from the upper surface of the support rail.

In the slat opening/closing drive mechanism of the above conventional shutter equipment, however, the chains are engaged with the sprockets inside the bent portions extending from the vertical guide rails in the slat stowing direction within the top box and as many as eight sprockets in all are used, so if the sprockets are disposed in proximity to the upper corner portions in the box, the chains engaged with the sprockets become too close to the inner wall of the box, resulting in interference of the chains and slats with the inner wall, and thus there occur inconveniences in the shutter opening and closing operation.

Therefore, the sprockets cannot be disposed in proximity to the upper corner portions in the top box or the slat stowing box, resulting in that a dead space is formed in the box. So the internal space cannot be utilized effectively and the entire equipment becomes larger in size, causing increase of the cost.

In the slat opening/closing drive mechanism of the above conventional shutter equipment, moreover, since the rotative shaft is supported only at both end portions thereof despite of it being a long shaft, the rotative shaft deflects and a slat moving in the slat stowing box interferes with the rotative shaft, whereby the rotation of the rotative shaft is prevented, so that the slats can no longer be operated smoothly for its opening or closing motion.

Further, in the above conventional shutter equipment, only both side portions of the upper end of each slat are supported on the support rails in a suspended state through the slat hanging rollers and the lower portion of the slat is free. As the slat hanging rollers roll on the support rails in this state, the slats move in a vertical posture, so if the slats are moved at high speed, the will be deflected largely due to wind pressure.

Such deflections cause the slats to interfere with each other, giving rise to a loud noise and flaw of the slats, thus requiring decrease of the slat moving speed.

In such conventional shutter slat hanging and supporting mechanism, the shaft portion of each slat hanging roller is supported in linear contact with the upper end of the vertical wall portion on one side of the support rail and the thickness of the said vertical wall portion corresponds to only the thickness of the metallic plate, that is, it is very thin, so that a considerable load including the weight of each slat acts concentratively on the vertical wall portion. Consequently, both the vertical wall portion and the roller shaft portion wear out in an early stage, thus resulting in loss of durability.

Further, the slat hanging rollers and the support rails must be formed of a metal to ensure strength sufficient to withstand the above concentrated load, thus leading to increase of the cost inevitably and causing a loud metallic noise during rolling of the rollers.

In the above conventional shutter slat support structure, pins for connection to chains are integrally projected from both sides of the upper portion of each slat and are inserted into partially bent portions of the chains through hollow pins rotatably and movably in the thrust direction. Therefore, it is impossible to make large the diameter of such chain connection pins and for this reason, although there is no problem in point of pin strength if the weight per slat is light, a heavy weight per slat inevitably requires increase in diameter of each pin to enhance the pin strength. In this case, it has been impossible to cope with this problem in point of pin strength unless the size of each chain itself is made larger.

When there occurs an error within an allowable range in the spacing between a pair of right and left guide rails to which are secured each slat through chains and rollers as mentioned above, each chain connection pin is moved in the thrust direction of the hollow pin of the chain to absorb and correct the error, but its moving stroke is restricted by the length of the hollow pin because the chain connection pin is inserted into the hollow pin extending through the chain link pin and the roller portion projecting from the chain, so when the above error is large, it is necessary to make the hollow pin longer to absorb and correct the error exactly by moving the pin.

However, making the hollow pin longer results in increase in the distance from the projecting roller up to the slat end portion from which the chain connection pin is projecting integrally, and this result is contrary to the market demand for a more compact structure.

SUMMARY OF THE INVENTION

The present invention has been accomplished to overcome all of the various problems encountered in the slat opening/closing drive mechanism and the slat hanging and supporting mechanism in the conventional shutter equipment described above. It has the following various objects.

It is the first object of the present invention to provide a slat opening/closing drive mechanism in a shutter equipment using sprockets the number of which is half the number of sprockets used in conventional like mechanism, whereby the number of components is decreased to a remarkable extent so the number of assembling steps decreases as well, thus permitting reduction in cost and also in the size of the entire equipment.

It is the second object of the present invention to provide a slat opening/closing drive mechanism in a shutter equipment in which sprockets engaged with slat connecting chains can be stowed in proximity to, for example, upper corner portions in the slat stowing box, whereby the dead space in the same box can be greatly decreased and yet slats can be moved for opening and closing motion smoothly and positively.

It is the third object of the present invention to provide a slat opening/closing drive mechanism in a shutter equipment capable of preventing deflection of the sprocket rotating shaft and thereby permitting the slats to be moved for opening and closing motion smoothly and positively.

It is the fourth object of the present invention to provide a shutter equipment capable of preventing deflection of the slats during movement in the slat stowing box, permitting smooth and fast movement of the slats and permitting reduction in the number of components of the vertical slat drive system, reduction of the cost and further reduction in size of the entire equipment.

It is the fifth object of the present invention to provide a shutter slat hanging and supporting mechanism capable of preventing wear of slat hanging rollers and support rails in an early stage to improve the durability and further capable of preventing the occurrence of noise during rolling of the slat hanging rollers and attaining reduction of the cost.

Sixthly, it is an object of the invention to provide a shutter slat supporting mechanism capable of enlarging the diameter of the slat supporting pin even without increasing the chain size to ensure a pin strength high enough to withstand the slat weight and also capable of attaining a compact structure.

In order to achieve the ahove-mentioned various objects, the shutter equipment of the present invention has the following constructional features.

Firstly, in a slat opening/closing drive mechanism embodying the present invention, a first sprocket is connected to the output shaft of a vertical slat drive means, and to a rotative shaft mounted in the slat stowing box are connected a second sprocket which is interlocked with the first sprocket through an endless chain, as well as third and fourth sprockets engaged with a pair of right and left chains which interconnect the slats.

Secondly, in a slat opening/closing drive mechanism embodying the present invention, vertical guide rails provided at the top thereof with a slat stowing box are disposed on both sides of a shutter opening/closing opening an a plurality of slats each retained on both sides by the vertical guide rails in a vertical movable manner and adapted to be moved into the slat stowing box along the vertical guide rails are interconnected bendably by a pair of right and left chains; further, chain-sprokect disengaging means for guiding the chains in a bent condition in the slat stowing direction within the box and sprockets each engaged with the outside of the bent portion of each chain in the vicinity of the chain-sprocket disengaging means are disposed in the slat stowing box and the said sprockets are rotated by the vertical slat drive means, thereby allowing the slats to be moved for opening or closing motion through the chains.

Thirdly, in a slat opening/closing drive mechanism embodying the present invention, an intermediate part of a rotative shaft mounted in the slat stowing box, having sprockets engaged with the above chains and adapted to be rotated by the vertical slat drive means is supported by a support member rotatably.

Fourthly, a shutter equipment embodying the present invention includes vertical guide rails disposed on both sides of a shutter opening/closing opening and provided at the top thereof with a slat stowing box; a plurality of slats retained on both sides thereof by the vertical guide rails in a vertically movable manner and interconnected bendably through chains which are movable into the slat stowing box along the vertical guide rails, the slats being adjacent to each other in the form of a single vertical plane between the vertical guide rails; support rails which allow the upper portions of the slats to be engaged therewith movably to suspend and support the slats in a parallel, folded state; slat deflection preventing lower rails which allow the lower portions of the slats to be engaged therewith to let the slats move in a vertical posture between the lower rails and the support rails; chain-sprocket disengaging means disposed between the lower rails and the support rails to guide the chains in a bent condition between those rails; and vertical slat drive means for moving the slats to the stowage position between the support rails and the lower rails and also to the draw-out position between both vertical guide rails.

Fifthly, in a shutter equipment embodying the present invention, which shutter equipment is provided with vertical guide rails disposed on both sides of a shutter opening/closing opening and having a slat stowing box; support rails for hanging and stowing slats which support rails are mounted within the slat stowing box; a plurality of slats retained vertically movably on both sides thereof by the vertical guide rails and interconnected adjacent each other bendably in the form of a single vertical plane; and slat hanging upper rollers provided on both sides of the upper portion of each slat, lower rollers are provided on both sides of the lower portion of each slat and slat deflection preventing lower rails for engagement with the said lower rollers are provided below the support rails in the slat stowing box.

Sixthly, in a shutter slat hanging and supporting mechanism embodying the present invention, slat hanging rollers are provided rotatably on both sides of the upper portion of each of plural slats which are engaged on both sides thereof with vertical guide rails vertically movably and which are interconnected adjacent each other bendably in the form of a single vertical plane, the vertical guide rails being disposed on both sides of a shutter opening/closing opening, and support rails for engagement therewith and support of the slat hanging rollers are disposed in a slat stowing box which is for receiving and stowing the slats from the vertical guide rails, the outer peripheral surface of the roller portion of each slat hanging roller being engaged with the upper surface of each support rail in the state of face contact.

Seventhly, outwardly projecting pins are provided on both sides in predetermined positions of the slat driving chains and slat hanging rollers are mounted rotatably on one end portions of the long pins, while the opposite ends of the long pins are connected to end portions of each vertically moving slat rotatably and movably in the thrust direction.

DETAILED DESCRIPTION OF THE PREFERRED EMBODIMENT

An embodiment of the present invention will be described hereinunder with reference to the drawings.

Figure 2:
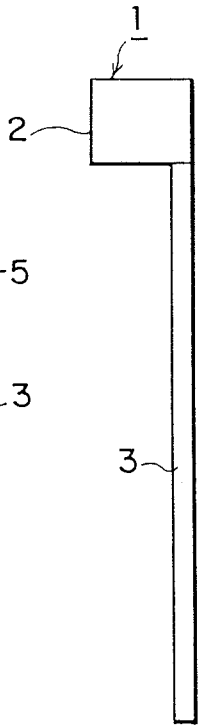
FIG. 2 is a side view thereof.
Figure 1:
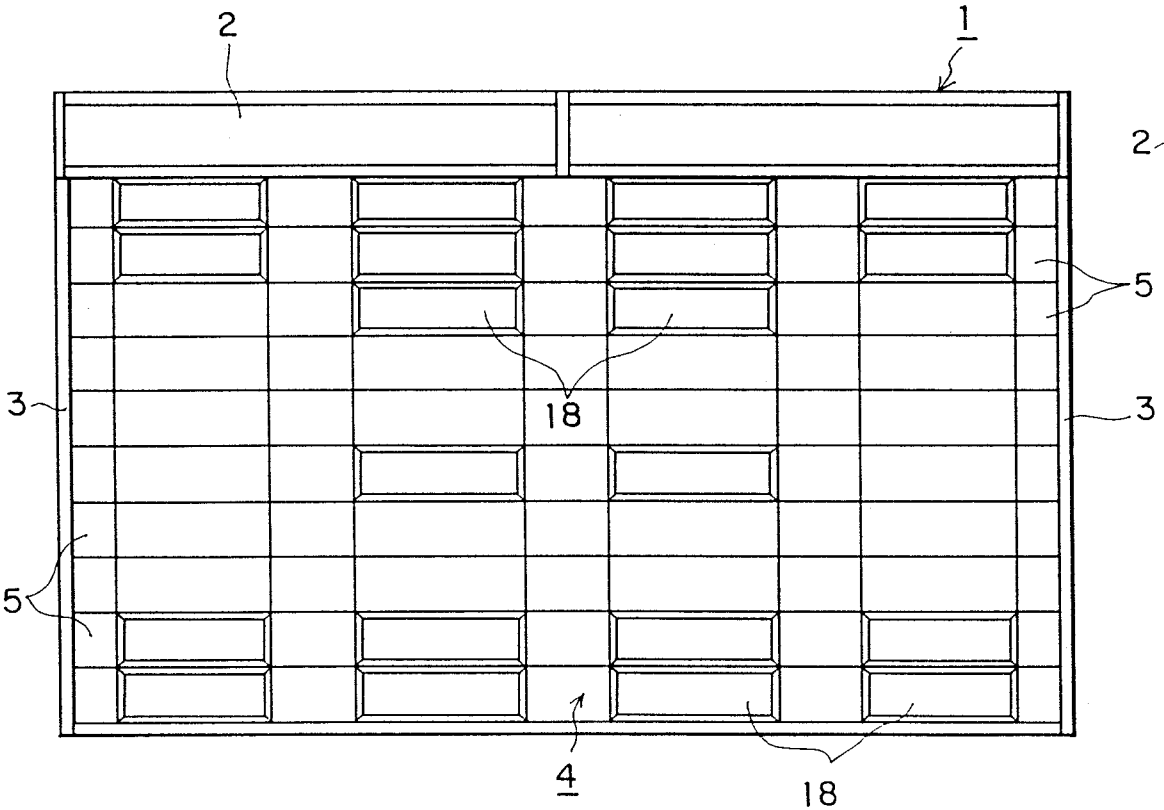
FIG. 1 is a front view of the whole of a shutter equipment according to an embodiment of the present invention.

A shutter equipment 1 shown in FIGS. 1 and 2 is provided with a shutter stowing box 2 disposed horizontally on top of a shutter opening/closing opening such as a building entrance or window, a pair of right and left vertical guide rails mounted vertically on both sides below the box 2, and a shutter 4 mounted vertically movably between the vertical guide rails 3.

Figure 6:
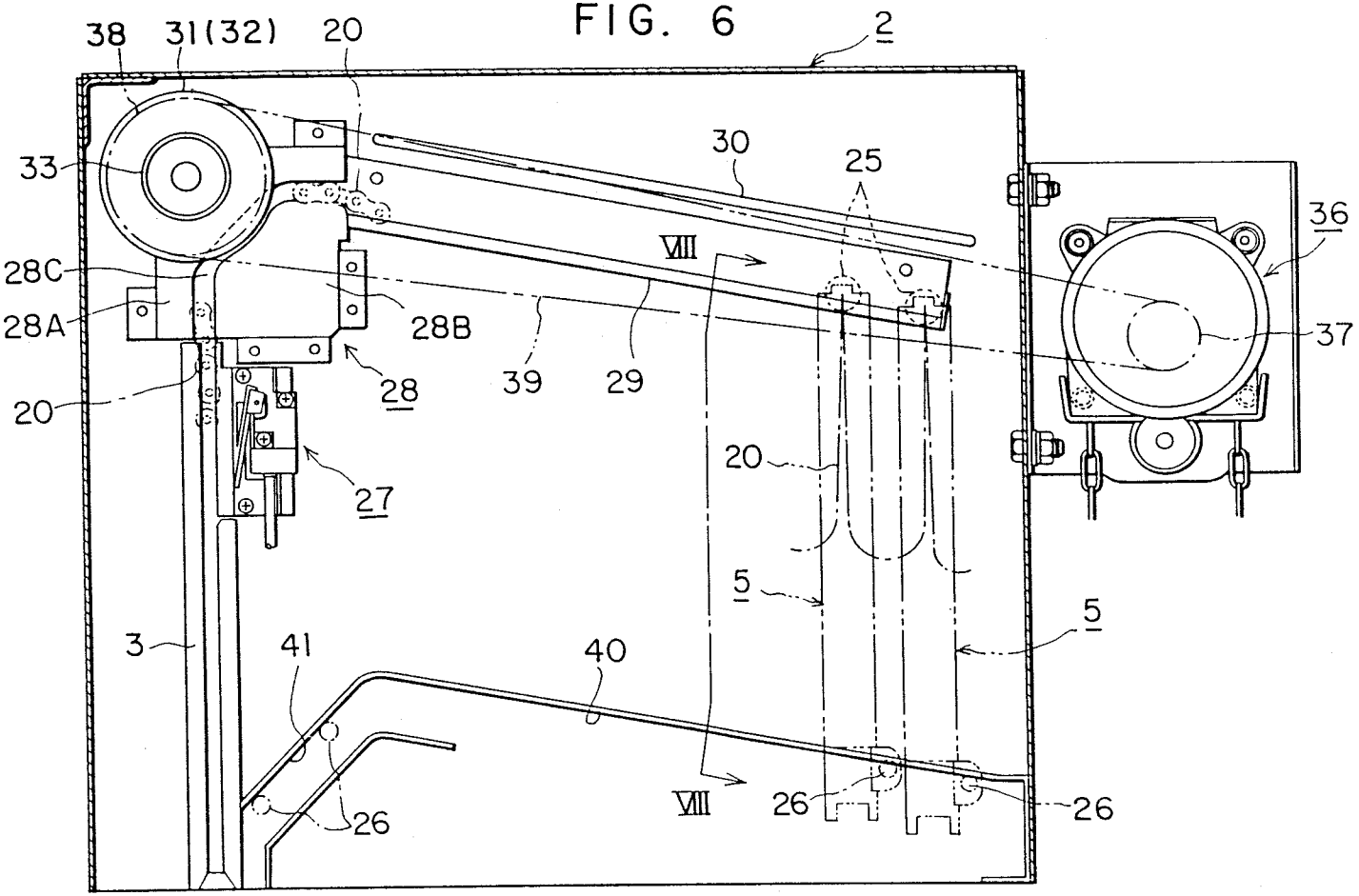
FIG. 6 is an enlarged side view in longitudinal section of a slat stowing box.

The shutter 4 is constituted by a plurality of interconnected slats 5. The slats 5 are held adjacent each other in a closed state in the form of a single vertical plane between both vertical guide rails 3, while in the box 2 they are suspended in a parallel, folded state as shown in FIG. 6.

Figure 3:
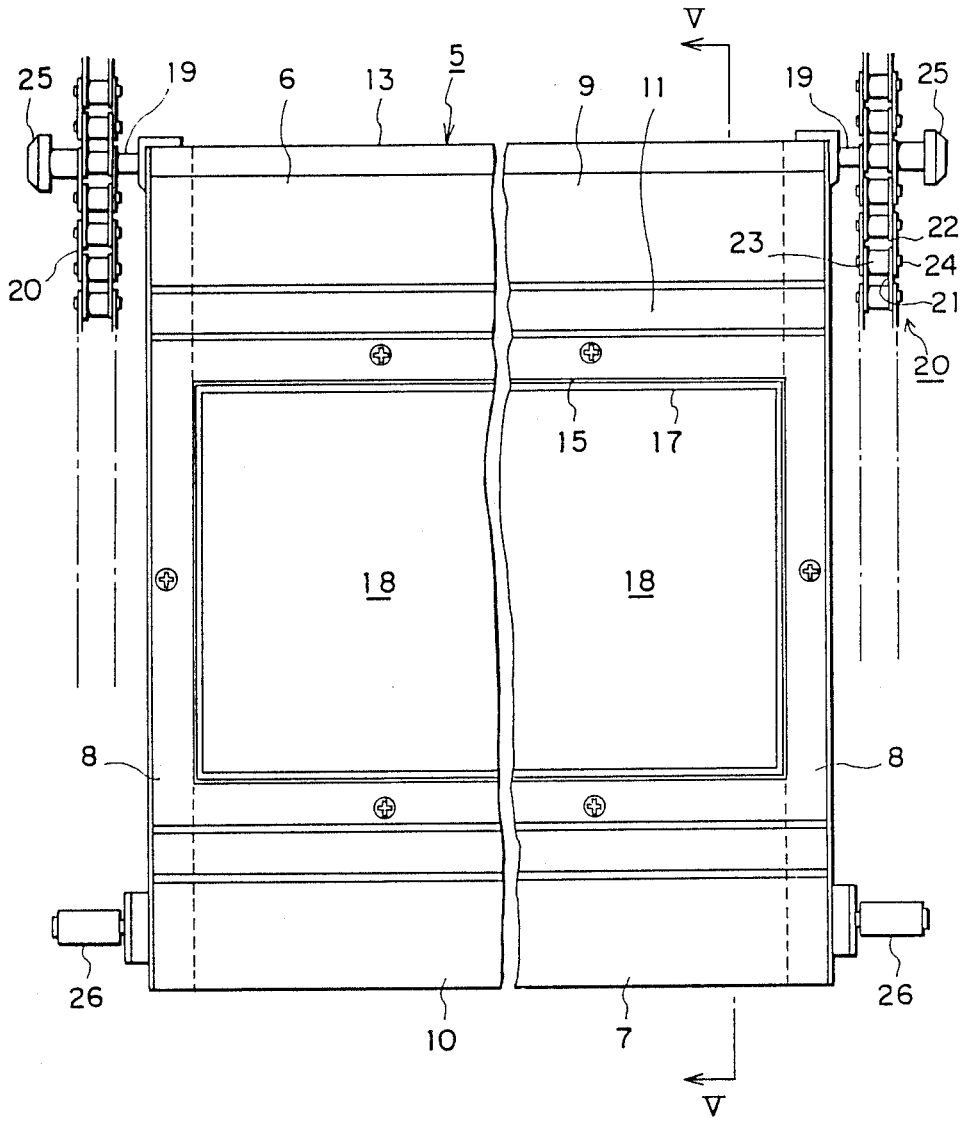
FIG. 3 is an enlarged front view of a slat connected to chains.
Figure 5:
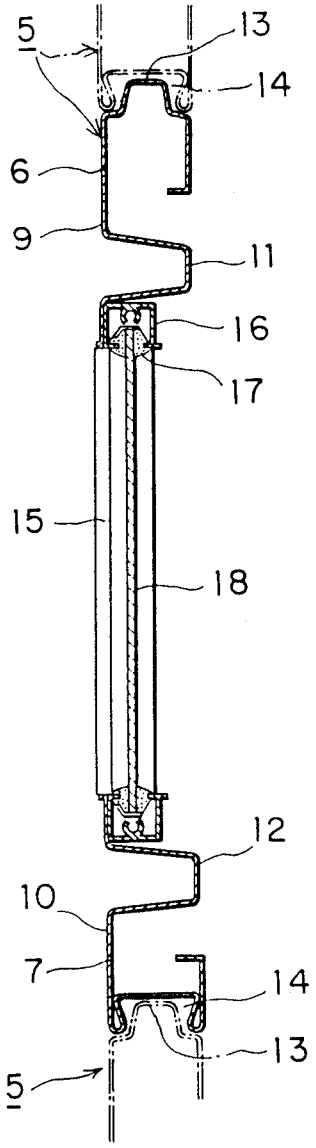
FIG. 5 is a sectional view taken on line V—V of FIG. 3.
Figure 4:
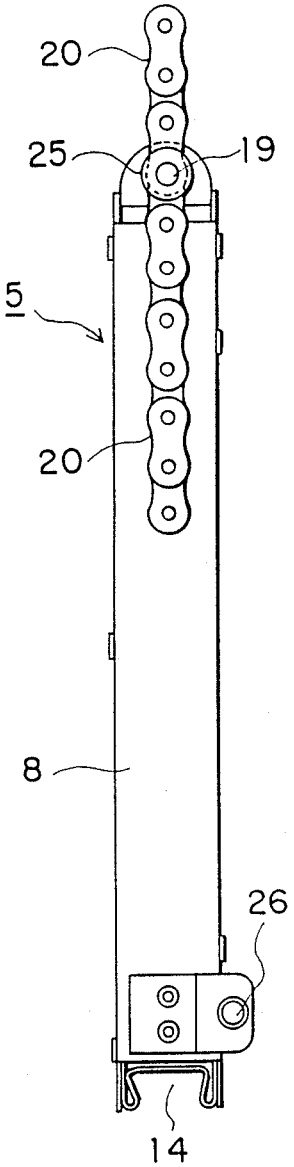
FIG. 4 is a side view thereof.

More specifically, in this embodiment, each slat 5 has an upper frame 6, a lower frame 7 and vertical frames 8 on both sides, as shown in FIGS. 3 and 4. The upper and lower frames 6 and 7 are formed by roll forming of a metallic plate of a light metal such as aluminum or steel and they have such sectional shape as shown in FIG. 5, for example.

In more particular terms, by roll forming of the above metallic plate the upper and lower frames 6 and 7 are integrally formed with main slat plate portions 9, 10, upper and lower reinforcing ribs 11 and 12 projecting to the back side, the ribs 11 and 12 being formed by depression in a laterally long slat shape of the surface side of each of the main slot plate portions 9 and 10, a fitting convex portion 13 formed along the upper end face of the upper frame 6, and a fitting concave portion 15 formed along the lower end face of the lower frame 7.

The upper and lower frames 6 and 7 are disposed in spaced relation in parallel with each other and the paired right and left vertical frames 8 having a ⊐-shaped section are fitted in and connected fixedly to both right and left end portions of the upper and lower frames 6 and 7, whereby a main portion of the slat 5 is assembled.

As a result of the above assembly there is formed a window opening 15, and behind the window opening 15 is mounted a window frame 16 between the reinforcing ribs 11 and 12.

A transparent plate 18 is fitted in and held by the window frame 16 through an elastic ring 17.

The slats 5 constructed as above are connected at equal intervals to a pair of right and left chains 20 on both sides of the respective upper ends through a long pin 19 as shown in FIGS. 3, 4, 8, 9 and 13.

As to the construction of the chains 20, in the conventional construction in which a pair of inside link plates 21 and a pair of outside link plates 22 are connected together through a bushing 23 and a link pin 24 and like connections stretch successively, the link pin 24 located in the mounting position of the slat 5 is removed from the bushing 23 and the long pin 19 is inserted therein rotatably.

The chains 20 are vertically driven in engagement with later-described sprockets 31 and 32 of the vertical slat drive system, whereby the plural slats 5 are moved up and down along the vertical guide rails 3 located on both sides in a suspended state through the chains 20.

On the fore end side of each long pin 19 is mounted a slat hanging upper roller 25 rotatably.

Further, at the lower end portions on both sides of each slat 5 are rotatably journalled lower rollers 26 serving as both a lifting guide and a deflection preventing means each in a biased position rearward from the center of each chain 20.

On the other hand, within the box 2 is provided a chain looseness detector 27 in the vicinity of the upper end of each vertical guide rail 3 as shown in FIG. 6.

The chain looseness detector 27 has the function of detecting the force of bending of each chain 20 caused by overlapping, stagnation, etc. of the slats 5 in the vertical guide rails 3, a warning function at the time of the detection, or an automatic stopping function for a later-described vertical slat drive means 36 (see FIGS. 6 and 10).

Figure 7:
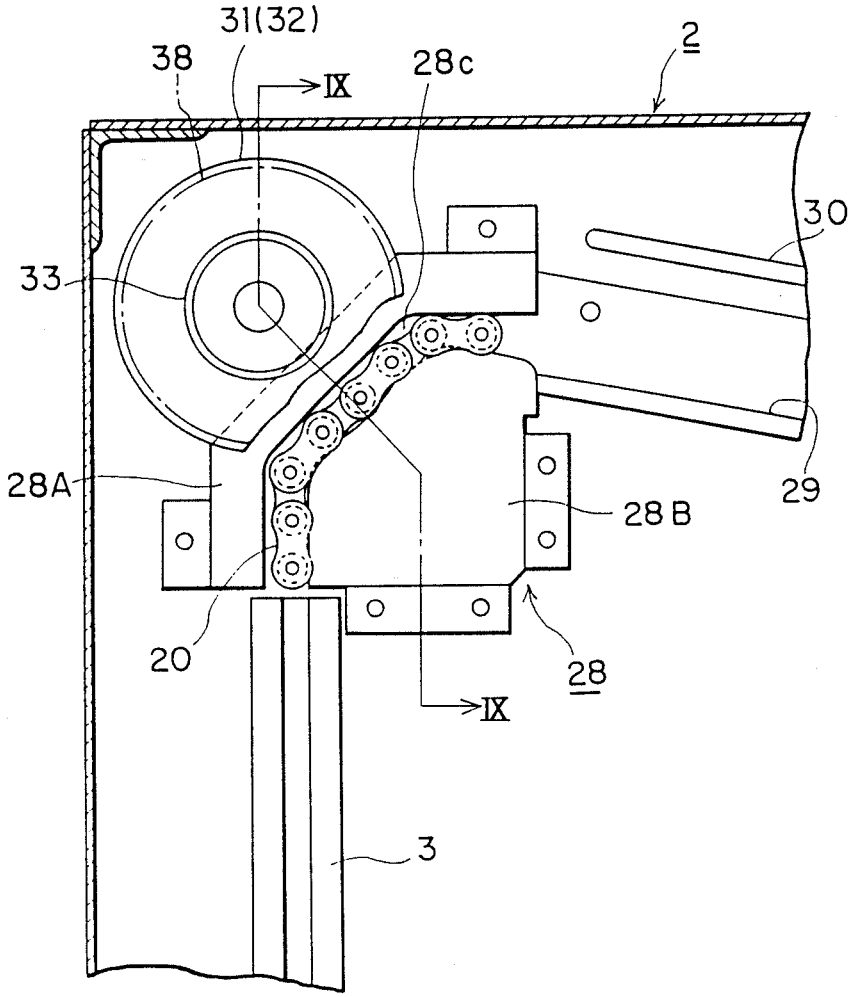
FIG. 7 is an enlarged view of the portion where a chain-sprocket disengaging means is mounted.

Within the box 2, as shown in FIGS. 6 and 7, there are disposed a slat hanging and stowing support rail 29 which is connected on the fore end side thereof to the upper end of each vertical guide rail 3 through a chain-sprocket disengaging means 28, as well as a chain fore end guide bar 30 disposed above in parallel with the support rail 29.

The above-described chain sprocket disengaging means 28 causes the chain 20 to be bent, guided and moved between the upper end of each of the vertical guide rails 3 and the front end of the support rail 29 and at the same time causes a smooth and positive disengaging operation between the chain 20 and the sprockets 31 and 32 to be performed. The chain sprocket disengaging means is comprised of an outside chain disengaging plate 28B and an inside chain disengaging plate 28B.

Figure 13:
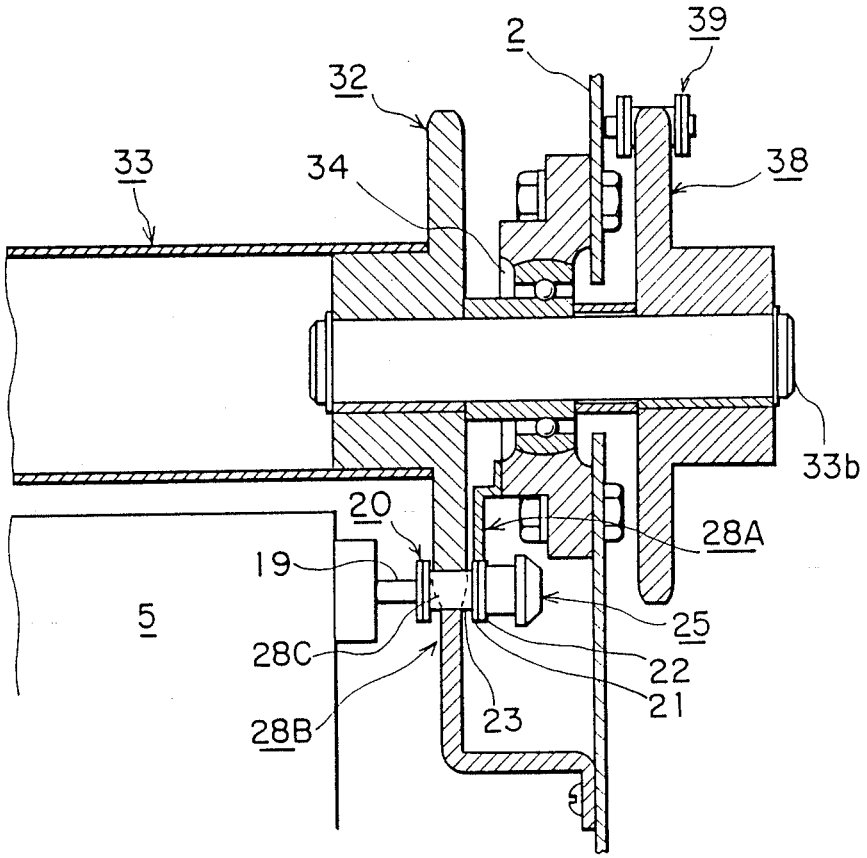
FIG. 13 is an enlarged sectional view taken on line IX—IX of FIG. 7.

In the chain bending guide passage 28C, as shown in FIG. 13, the outside of the inner and outer link plates 21 and 22 of the chain 20 is in sliding contact with the outside chain disengaging plate 28A, while on the opposite side the bushing 23 of the chain 20 is in sliding contact with the inside chain disengaging plate 28B, whereby the chain 20 is bent and moved smoothly.

Thus, the chain 20 is positively guided to the engaging position of the sprockets 31 and 32 by the outside chain disengaging plate 28A and the inside chain disengaging plate 28B and at the same time the chain 20 is, at the disengaged position with the sprockets 31 and 32, forcedly disengaged from the sprockets 31 and 32 by the inside chain disengaging plate 28B.

The support rail 29 is inclined downwards gradually toward the rear side distant from the chain-sprocket disengaging means 28, and the upper roller 25 of the chain 20 past the chain bending guide passage 28C comes into rolling engagement with the support rail 29, whereby the slats 5 are suspended in a parallel, folded state.

Figure 8:
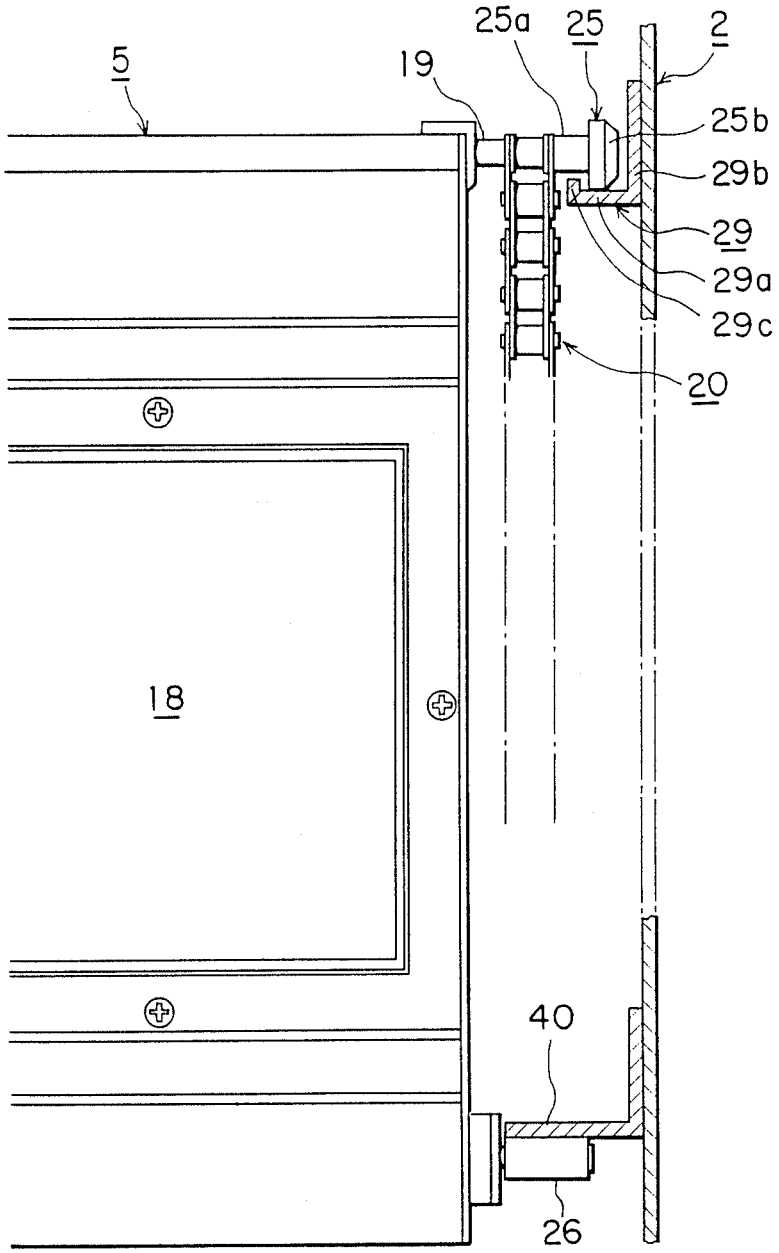
FIG. 8 is a sectional view taken on line VIII—VIII of FIG. 6.

As shown in FIG. 8, the support rail 29 comprises a bottom portion **29*a* and both side wall portions 29*b* and 29*c* rising from the bottom portion, one side wall portion 29*b* being secured to an inner side wall of the box 2**.

On the other hand, the upper roller 25 comprises a roller shaft portion **25*a* connected coaxially to the fore end of the long pin 19 and a roller portion 25*b* connected integrally with the roller shaft portion 25*a***.

The outer peripheral surface of the roller portion **25*b* is engaged with the upper surface of the bottom portion 29*a* of the support rail 29 in the state of face contact. By such face contact of the roller portion 25*b* with the bottom portion 29*a* there is obtained a sufficient strength even when the upper roller 25 is integrally formed of a synthetic resin, not a metal. Consequently, there are attained reduction of the wear between the roller portion 25*b* and the bottom portion 29*a***, improvement of durability, decrease of noise and reduction of the cost.

The fore end of the chain 20 is loosely fitted movably on the chain fore end guide bar 30, allowing the chain 20 to move following the slat 5.

Further, on both sides of the upper portion in the box 2, a pair of left and right chain driving sprockets 31 and 32 are journalled rotatably in the vicinity of the chain-sprocket disengaging means 28. The sprockets 31 and 32 are integrally connected coaxially by a rotative shaft 33.

Figure 9:
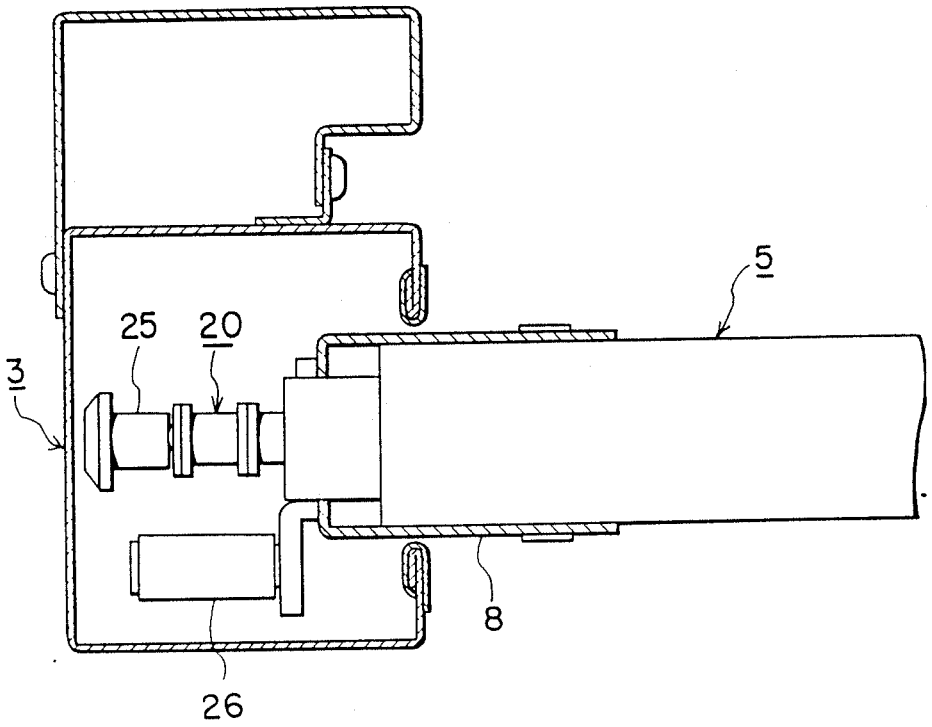
FIG. 9 is an enlarged transverse sectional view of a vertical guide rail (3)
Figure 10:
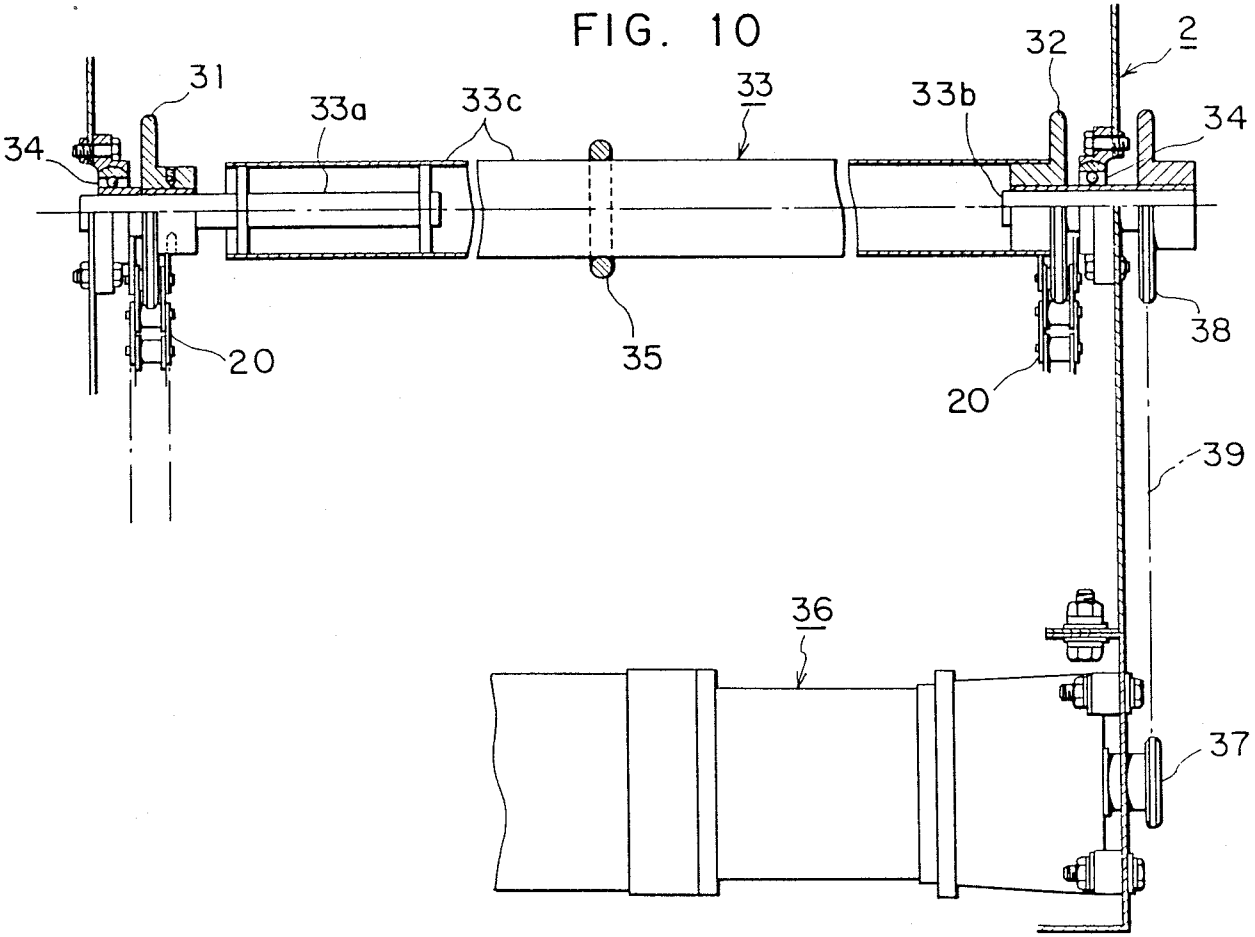
FIG. 10 is a constructional diagram of a vertical slat drive system.

As shown in FIGS. 8 to 10, the rotative shaft 33 comprises rotative shaft portions **33*a* and 33*b* of a small diameter attached to both side walls of the box 2 each rotatably through a bearing 34 and with the sprockets 31 and 32 integrally mounted thereon, and a cylindrical shaft portion 33*c* of a large diameter which interconnects the small-diameter rotative shaft portions 33*a* and 33*b*** coaxially integrally.

The rotative shaft 33 is considerably long, corresponding to the length of each slat 5, so it is heavy and deflects easily. This deflection causes interference of the rotative shaft 33 with the upper end portion of the slat 5 being guided and moved along the chain bending guide passage 28C and so there is fear of a smooth movement of the slat 5 being impeded. To prevent this, an approximately intermediate part of the large-diameter cylindrical shaft portion **33*c* is supported rotatably by a U-shaped support member 35 as shown in FIGS. 10 to 12, thereby preventing deflection of the rotative shaft 33, that is, preventing the slat 5 from being impeded its movement by the rotative shaft 33**.

Figure 11:
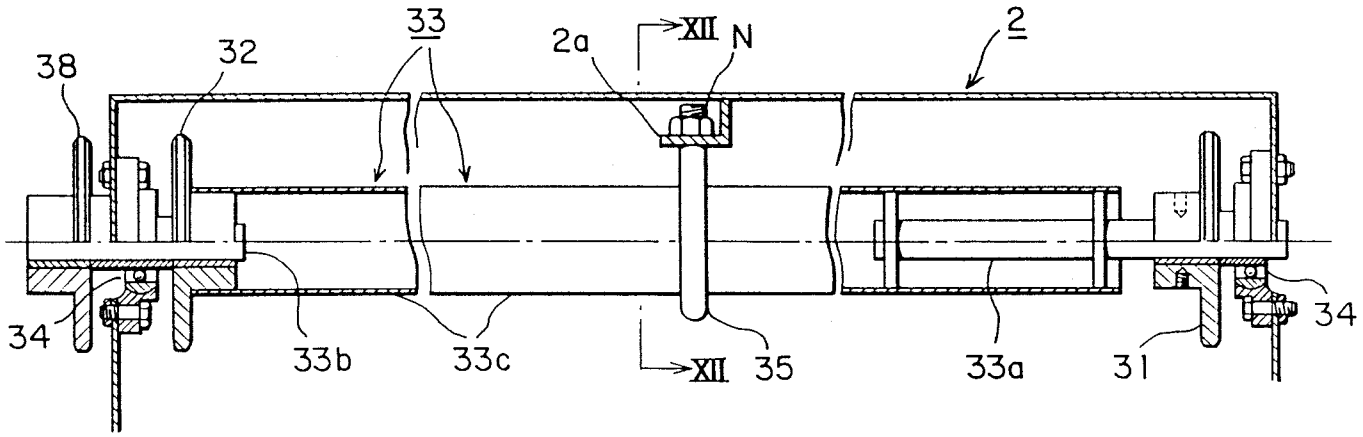
FIG. 11 is a sectional view of the portion where a sprocket rotating shaft is mounted.
Figure 12:
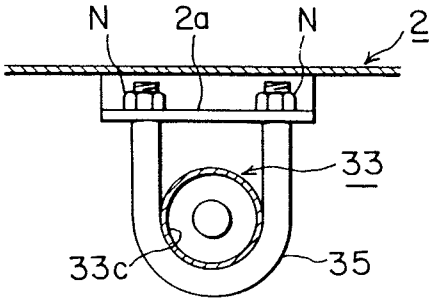
FIG. 12 is a sectional view taken on line XII—XII of FIG. 11.

The support member 35 is clamped with nuts N through an intermediate reinforcing frame **2*a* in the box 2 as shown in FIGS. 11 and 12. The support member 35 may be welded at both end portions to the intermediate reinforcing frame 2*a*, and the intermediate part of the large-diameter cylindrical shaft portion 33*c* may be supported by the support member 35** through a bearing.

The chains are in engagement with the sprockets 31 and 32. More specifically, as shown in FIGS. 6, 7 and 13, the outside of the bent portion of each chain 20 bent in the chain bending guide passage 28C is engaged with the lower side of the sprocket 31 or 32. By such a way of engagement, the sprockets 31 and 32 can be disposed in close proximity to the upper corner portions in the box 2, resulting in that the dead spaces in the vicinity of the lower side of the sprockets 31 and 32 in the box 2 can be diminished.

The sprockets 31 and 32 are rotated forward and reverse by a vertical slat drive means 36 which is shown in FIGS. 6 and 8. The vertical slat drive means 36 comprises a geared motor secured to one inner side wall of the box 2, and an endless chain 39 is wound round both a first sprocket 37 on the output side mounted on the output shaft of the geared motor and a second sprocket 38 on the input side fitted on one small-diameter rotative shaft portion 33*a* of the rotative shaft 33, whereby the vertical slat drive means 36 and both sprockets 31, 32 are interlocked with each other. Thus, the sprockets 31 and 32 serve as third and fourth sprockets which rotate integrally with the rotative shaft 33.

In lower positions in the box 2, moreover, there are disposed slat deflection preventing lower rails 40 in parallel with the support rails 29, as shown in FIGS. 6 and 8. Each lower rail 40 is connected at its front end to each vertical guide rail 3 on the inlet side of the box 2 and it has a slat guide portion 41 which is inclined in the same direction as the chain bending guide passage 28C.

When the upper rollers 25 of each slat 5 move in engagement with the upper surfaces of the support rails 29, the lower rollers 26 of the slat move in engagement with the lower surfaces of the lower rails 40, whereby the slat 5 is moved while being held in a vertical posture between the lower rails 40 and the support rails 29 to prevent deflection of the slat 5.

The operation of the above embodiment will now be described. The upper rollers 25 of each slot 5 are supported on the support rails 29 in the box 2 and the lower rollers 26 are engaged with the lower surfaces of the lower rails 40, whereby the slats 5 are folded and suspended in parallel with one another. When in this stowed state the vertical slat drive means 36 is started to rotate in one direction, the rotative shaft 33 rotated in one direction through the first sprocket 37 on the output side, the endless chain 39 and the input sprocket 38.

And by the third and fourth sprockets 31 and 32 rotating integrally with the rotative shaft 33, the chains 20 which interconnect the slats 5 held between the support rails 29 and the lower rails 40 are delivered from above to both vertical guide rails 3. As a result, the slats 5 go down successively to the respective positions to close the opening such as a window between the vertical guide rails 3. Now the shutter is in use.

When in this state the vertical slat drive means 36 is started to rotate reverse, the chains 20 go up along the vertical guide rails 3 and enter the box 2. In this case, the upper rollers 25 of each slats come into engagement with the upper surfaces of the support rails 29 through the chain bending guide passages 28C of the chain-sprocket disengaging means 28. At the same time, the lower rollers 26 of each slat 5 come into engagement with the lower surfaces of the lower rails 40 through the slat guide portions 41 of the lower rails 40 and move in this state. Consequently, the deflection of each slat 5 is prevented, and as the slats 5 shift onto the support rails 29, they are stowed in the box 2 successively in a folded and suspended state.

A detailed construction of the slat 5 suspended from the chain 20 will be explained below using FIG. 14.

Figure 14:
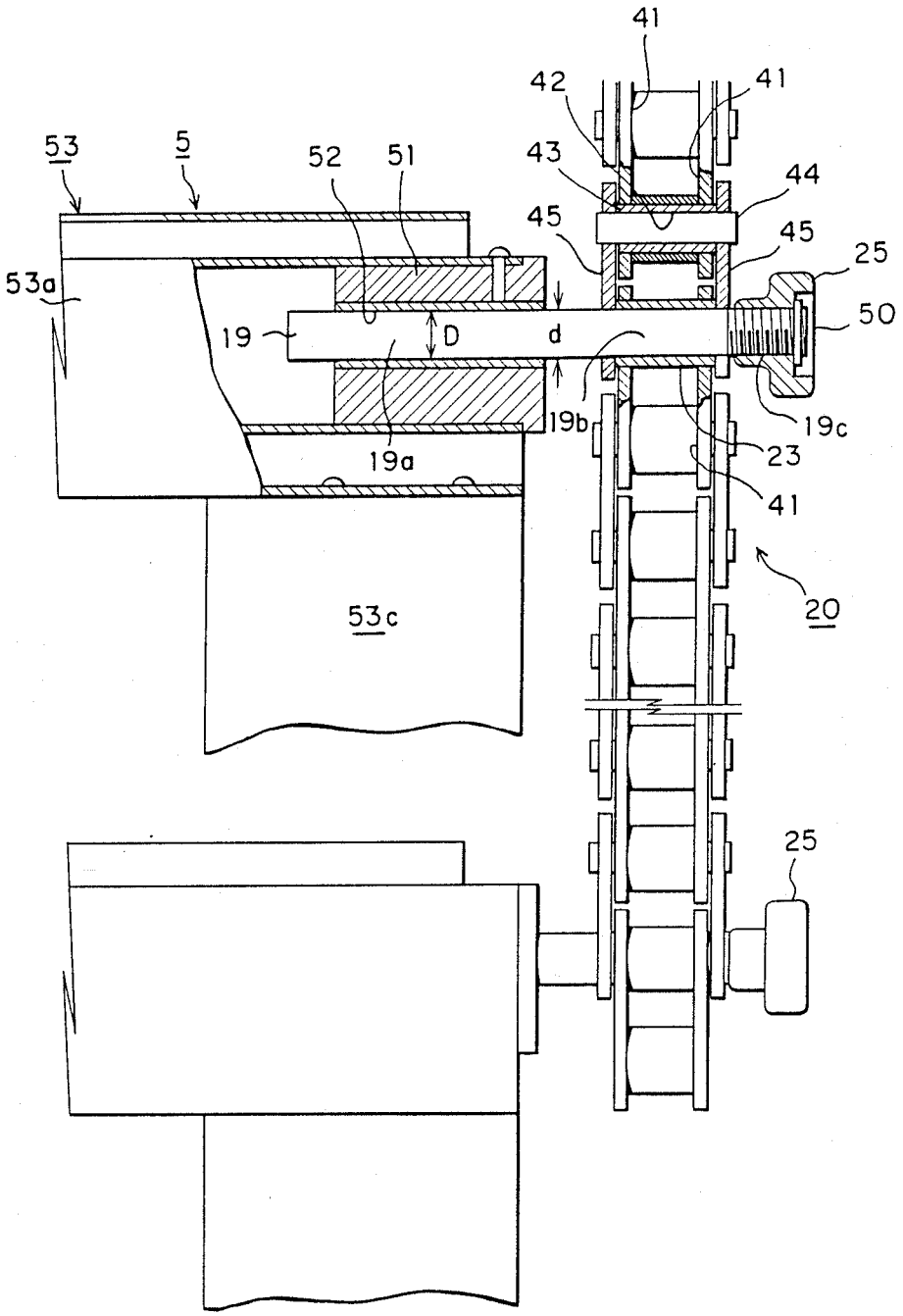
FIG. 14 is a partially sectional front view showing details of a supporting mechanism for hanging and supporting slats from chains in the shutter equipment of the present invention.

As shown in FIG. 14, the chain 20 has a pair of right and left roller link plates 41, a hollow cylindrical bushing 42 press-fitted and fixed between both end portions of the roller link plates 41, a roller 43 loosely fitted on the bushing 42 rotatably, a pin 44 inserted rotatably into the bushing 42, and pin link plates 45 disposed outside the roller link plates 41 and caulked to both end portions of the pin 44. Plural such roller link plates 41 and plural such pin link plates 45 are connected bendably alternately with plural such pins 44 arranged at chain pitch intervals.

In the position of each chain 20 where the slat 5 is mounted and supported, there is provided a long pin 19 through a bushing 23.

The bushing 23 is in the form of a hollow cylinder, having an outside diameter of the same size as the roller 43, and it is press-fitted and fixed between end portions of the roller link plates 41.

The long pin 19 is composed of a slat mounting shaft portion 19*a* of the largest diameter, a link connecting shaft portion 19*b* of a smaller diameter and a roller mounting shaft portion 19*c* of a diameter even smaller than that of the link connecting shaft portion 19*b*, the shaft portions 19*a*, 19*b* and 19*c* being integrally formed coaxially.

In the long pin 19 having such construction, its link connecting shaft portion 19*b* is inserted into the bushing 23 and end portions of the pin link plates 45 are fixed by caulking to the link connecting shaft portion 19*b*, whereby the roller link plates 41 and the pin link plates 45 are connected bendably. Further, since the bushing 23 and the roller 43 are of the same size, the chains in thus shutter equipment can be operated with standard sprockets even without using any special sprockets.

A slat hanging roller 25 is rotatably fitted on the roller mounting shaft portion 19*c* and it is prevented from coming off the shaft portion 19*c* by means of a C-shaped retaining ring 50 attached to the outer end of the shaft portion 19*c*.

Each end side of the upper portion of the slat 5 is supported on the slat mounting shaft portion 19*a* through a long pin supporting bracket 51 and a long pin supporting bushing 52.

The long pin supporting bracket 51 is fixed at each end portion or throughout the overall length of an upper frame 53*a* of a slat holding frame 53.

The long pin supporting bushing 52 is in the form of a hollow cylinder, having an inside diameter D slightly larger than the outside diameter, d, of the panel mounting shaft portion 19*a* of the long pin 19.

The long pin supporting bushing 52 is inserted and fixed into the long pin supporting bracket 51 by being press-fitted or any other suitable means.

And the slat mounting shaft portion 19*a* of the long pin 19 is inserted into the long pin supporting bushing 52 rotatably and movably in the thrust direction to thereby support the slat 5.

Further, since the long pin supporting bracket 51 is mounted from an end portion of the slat 5 toward the opposite end portion, the length of the long pin 19 can be made sufficiently large and the moving range in the thrust direction can be widened while maintaining structure compact.

One long pin 19 may be made long enough to be used in common with the long pin at the opposite end.

A lower slat roller is rotatably journalled at the lower end portion of each slat holding frame 53 in the flat 5.

The long pin supporting bracket 51 may be formed by any suitable means such as, for example, metal plate bending or drawing, or die casting or injection. Moreover, although the long pin supporting bracket 51 and the long pin supporting bushing 51 are shown separately as members for use as a pair in the illustrated embodiment, there may be adopted a structure in which the panel mounting shaft portion 19a of the long pin 19 is in direct contact with the long pin supporting bracket 51.

As explained in detail hereinabove, the following various effects are attained according to the slat opening/closing drive mechanism in the shutter equipment of the present invention.

Firstly, according to the present invention, only four sprockets are needed in comparison with the prior art requiring eight sprockets. Thus, number of sprockets required decreases to half and the structure becomes extremely simple, that is, the number of assembling steps decreases to a great extent, resulting in that there can be attained reduction of cost and also reduction in size of the entire equipment.

Secondly, according to the present invention, a plurality of slats are interconnected bendably and the chains which move up and down along the vertical guide rails and which are bent and guided in the incoming and outgoing direction in the slat stowing box by the chain-sprocket disengaging means, are each engaged at the outside of the bent portion thereof with the lower portion of a sprocket of the vertical slat drive system, so even when such sprockets for both chains are disposed near the inner wall surface of the slat stowing box, the chains are held in positions largely spaced from that close position, resulting in that the chains and the slats will never interfere with the inner wall surface of the box. Besides, since the chains are each held in the state of engagement with the sprocket positively by the chain-sprocket disengaging means, the slats can be operated for opening and closing motion smoothly and positively and it becomes possible to dispose the sprockets of the vertical slat drive system in positions close to the inner wall of the box, for example in upper corner portions of the box, resulting in that the inside space of the box can be utilized effectively and so the reduction in size and cost of the entire equipment can be attained.

Thirdly, according to the present invention, since an intermediate part of the long sprocket rotating shaft mounted in the slat stowing box is supported rotatably by a support member, the deflection of the sprocket rotating shaft can be prevented by the said support member, so that the moving slats in the box will no longer interfere with the said rotating shaft, thus permitting smooth and positive movement of the slats in the opening and closing directions.

Fourthly, according to the present invention, support rails for engagement therewith of the slat hanging rollers at the upper portion of each slat and lower rails for engagement therewith of the lower rollers are disposed in the slat stowing box so that at the time of stowage of slats into the box and also at the time of delivery thereof from the same box the slat hanging rollers and the lower rollers roll in engagement with the support rails and the lower rails, respectively. Consequently, the slats are prevented from being deflected by, for example, wind pressure and interfering with each other during movement in the slat stowing box. So the occurrence of noise and flaw caused by deflection of the slats is prevented and it becomes possible to effect a smooth and fast opening and closing operation of the slats.

Also in the vertical slat drive means, the number of sprockets decreases to half in comparison with the prior art so the structure is simplified whereby the reduction in cost and in size of the entire equipment can be attained.

Fifthly, according to the present invention, during movement of the slats in the slat stowing box, the slat hanging rollers at the upper portion of each slat are brought into engagement with the upper surfaces of the support rails, whereupon the lower rollers of the slat come into engagement with the lower rails, so that the slat moves while being supported at its upper and lower end portions. Consequently, the deflection of the slat caused by wind pressure is prevented and the interference of the slats with each other as well as the resultant noising or flawing is prevented, permitting the slat to move in its opening and closing directions smoothly at high speed.

Sixthly, according to the present invention, a plurality of slats are interconnected bendably and chains which move up and down along the vertical guide rails and which are bent and guided in the incoming and outgoing direction in the slat stowing box by the chain-sprocket disengaging means, are each engaged at the outside of its bent portion with the lower portion of a sprocket of the vertical slat drive system, so even when the sprocket is disposed close to the inner wall surface of the slat stowing box, the chains are held in positions spaced larger than that close distance, so that the chains and the slats are prevented from interfering with the inner wall surface of the box. Besides, since the engagement of the chains with such sprockets of the vertical slat drive system is maintained positively by the chain-sprocket disengaging means, the slats can be operated for opening and closing motion smoothly and positively and it becomes possible to dispose the sprockets in positions close to the inner wall surface of the slat stowing box, for example in upper corner portions, thus permitting effective utilization of the internal space of the box and consequent reduction in size and cost of the entire equipment.

Seventhly, according to the present invention, outwardly projecting long pins are provided on both sides through bent portions of the chains and slat hanging rollers are mounted on end portions of the long pins, while the opposite end portions of the long pins are connected to end portions of the slat rotatably and movably in the thrust direction, so only the slat connecting side of each long pin can be made large in diameter without changing the chain size itself. Consequently, the strength of the long pin can be enhanced in response to increase in weight of the slat. Besides, the long pin rotatable and thrust-movable with respect to the slat, a spacing error between the guide rails can be absorbed and corrected easily by movement in the thrust direction of the long pin. As a result, the working efficiency during mounting can be improved to a great extent and expansion or contraction after the mounting can be coped with automatially.

What is claimed is:

1. A slat drive mechanism for a shutter equipment having vertical guide rails disposed on both sides of a shutter opening and provided with a slat stowing box, and a plurality of slats movably retained by and between said vertical guide rails and interconnected by a pair of flexible right and left chains which are movable into the slat stowing box, the slats being movable between a pulled-out position in which the slats are disposed adjacent to each other in the form of a single vertical plane between the vertical guide rails and a stowed position in which said slats are disposed in said box, comprising:

a vertical slat drive means for moving the slats vertically along said vertical guide rails, a first sprocket connected to an output shaft of said vertical slat drive means; a second sprocket mounted on a rotative shaft disposed in said box, an endless chain drivingly connecting said second sprocket with said first sprocket; third and fourth sprockets mounted respectively on each end of said rotative shaft; and said right and left chains being drivingly engaged with lower portions of said third and fourth sprockets.

2. A slat drive mechanism as recited in claim 1, wherein said slat drive means comprises a motor and said first sprocket is concentrically mounted on the output shaft of said motor.

3. A slat drive mechanism as recited in claim 1, wherein an intermediate part of said rotative shaft is rotatably supported by a supporting member arranged in said box.

4. A shutter equipment having vertical guide rails disposed on both sides of a shutter opening and provided with a slat stowing box; slat hanging and stowing support rails disposed in said box; a plurality of slats movably retained by and between said vertical guide rails and flexibly interconnected adjacent each other such that they form of a single vertical plane when in a pulled-out position; slat drive means connected to an upper side of each side slat for moving said slats between said pulled-out position and said stowed position; slat hanging upper rollers provided on both sides of the upper portion of each said slat, said upper rollers being in engagement with the upper surfaces of said support rails and suspending the slats in a parallel, folded state when in a stowed position; and a slat deflection preventing mechanism comprising lower rollers provided on both sides of the lower portion of each said slat, and slat deflection preventing lower rails disposed in parallel below said support rails in said box for engagement therewith of said lower rollers upon engagement of said upper rollers with the upper surfaces of said support rails.

5. A shutter equipment including vertical guide rails disposed on both sides of a shutter opening and provided with a slat stowing box; a plurality of slats movably retained by and between said vertical guide rails and interconnected by flexible chains which are movable into the slat stowing box, said chains being attached to upper ends of said slats, the slats being movable between a pulled-out position in which the slats are disposed adjacent to each other in the form of a single vertical plane between the vertical guide rails and a stowed position in which said slats are disposed in said box; support rails disposed in said box for movable engagement therewith of upper portions of said slats to hang and support the slats in a parallel, folded state; slat deflection preventing lower rails disposed in parallel below said support rails for engagement therewith of lower portions of said slats so as to maintain said slats in a substantially vertical orientation while moving along said support rails; and vertical slat drive means having sprockets engaged with said chains adjacent said support rails to move said slats between said stowed position and said pulled-out position.

6. A shutter equipment as recited in claim 5, further comprising chain sprocket disengaging means disposed between said vertical guide rails and said support rails for bending and guiding said chain as it moves between said vertical guide rails and said support rails.

7. A shutter equipment as recited in claim 5, further comprising slat hanging rollers provided on an upper portion of each said slat, each said roller having a shaft portion and a roller portion concentrically mounted about said shaft portion, each said roller portion being in rolling engagement with an upper portion of one of said support rails when in the stowed position.

8. A shutter equipment as recited in claim 5, further comprising long pins rotatably and axially adjustably connected to end portions of each said slat and projecting through portions of said chains to thereby connect said slats to said chains, and slat hanging rollers rotatably mounted on a free end of each said long pins.

9. A slat drive mechanism for a shutter equipment including vertical guide rails disposed on both sides of a shutter opening and having a slat stowing box; a plurality of slats movably retained by and between said vertical guide rails and interconnected by a pair of flexible right and left chains which are movable into said box; a chain-sprocket disengaging means disposed into said box for bending and moving the chains in a slat stowing direction in the box; a shaft rotatably mounted in the box; sprockets coaxially mounted on said shaft in an upper portion of said box and in the vicinity of said chain-sprocket disengaging means; a lower portion of each sprocket engaging the outside of a bent portion of each said chain; and vertical slat drive means for driving said sprockets and chains to move the slats in opening and closing directions; said disengaging means comprising a first plate means for slidably contacting said right and left chains from above and a second plate means for slidably contacting said right and left chains from below, to thereby bend and guide said right and left chains in the slat stowing direction.

* * * * *